US011428376B1

(12) United States Patent
Xin

(10) Patent No.: US 11,428,376 B1
(45) Date of Patent: Aug. 30, 2022

(54) PROJECTION DEVICE

(71) Applicant: Yuanting Xin, Shenzhen (CN)

(72) Inventor: Yuanting Xin, Shenzhen (CN)

( * ) Notice: Subject to any disclaimer, the term of this patent is extended or adjusted under 35 U.S.C. 154(b) by 0 days.

(21) Appl. No.: 17/518,537

(22) Filed: Nov. 3, 2021

(30) Foreign Application Priority Data

Oct. 9, 2021 (CN) ..... 202122431363.9

(51) Int. Cl.

| | |
|---|---|
| ***F21S 10/06*** | (2006.01) |
| ***F21V 5/04*** | (2006.01) |
| ***F21V 5/00*** | (2018.01) |
| ***F21V 11/16*** | (2006.01) |
| ***F21W 121/00*** | (2006.01) |
| ***F21S 10/00*** | (2006.01) |

(52) U.S. Cl.
CPC ..... *F21S 10/063* (2013.01); *F21V 5/002* (2013.01); *F21V 5/04* (2013.01); *F21V 11/16* (2013.01); *F21S 10/007* (2013.01); *F21W 2121/008* (2013.01)

(58) Field of Classification Search
CPC ..... F21S 10/063; F21S 10/007; F21V 5/002; F21V 11/16; F21W 2121/008; F21W 2121/00
USPC ..... 362/35, 282, 806
See application file for complete search history.

(56) References Cited

U.S. PATENT DOCUMENTS

| | | | | |
|---|---|---|---|---|
| 9,900,566 | B2 | 2/2018 | Guo | |
| 10,863,095 | B2 | 4/2020 | Fujita | |
| 11,032,526 | B2 | 6/2021 | Tsao et al. | |
| 2003/0067588 | A1* | 4/2003 | Belliveau | H04N 9/3152 353/31 |
| 2014/0226336 | A1* | 8/2014 | Chi | F21V 14/08 362/280 |
| 2015/0109797 | A1* | 4/2015 | Jurik | F21V 11/186 362/321 |

* cited by examiner

*Primary Examiner* — Laura K Tso
(74) *Attorney, Agent, or Firm* — Benjamin H.B. Sley

(57) ABSTRACT

A projection device includes a first light-emitting component including a first light-emitting member, a first light-transmitting member, a first driving member and a first lens. The first light-emitting member is used for generating a linear light band; the first light-transmitting member is defined with a first linear light-transmitting region; the first driving member is fixedly connected with the first light-emitting member or the first light-transmitting member, and used for allowing the first light-emitting member and the first light-transmitting member to generate a relative motion, and allowing the linear light band to intersect with the first linear light-transmitting region; and the first lens, the first light-emitting member, the first light-transmitting member and the first lens are sequentially arranged. The projection device of the present disclosure is capable of generating the dynamic meteor effect to improve the user experience.

9 Claims, 8 Drawing Sheets

PROJECTION DEVICE

CROSS-REFERENCE TO RELATED APPLICATIONS

This application claims priority to Chinese Patent Application No. 202122431363.9 with a filing date of Oct. 9, 2021. The content of the aforementioned application, including any intervening amendments thereto, is incorporated herein by reference.

TECHNICAL FIELD

The present disclosure relates to the field of illumination, in particular to a projection device.

BACKGROUND

A projection lamp, also known as an ambient lamp, is used in indoor places such as bedrooms and living rooms. The projection lamp is used to create an ambience, such as a starry sky and water ripples. However, the existing starry sky projection lamps only generate static starry sky patterns during projection, therefore the effect is simplex.

SUMMARY

The technical problem to be solved by the present disclosure is to provide a projection device to overcome the above shortcomings of the prior art, so as to improve the defect of a simplex effect of the starry sky projection lamp within the scope of the prior art.

An embodiment of the present disclosure provides a projection device, which includes a first light-emitting component, where the first light-emitting component includes:

a first light-emitting member, used for generating a linear light band;

a first light-transmitting member, defined with a first linear light-transmitting region;

a first driving member, fixedly connected with the first light-emitting member or the first light-transmitting member, and used for allowing the first light-emitting member and the first light-transmitting member to generate a relative motion, and allowing the linear light band to intersect with the first linear light-transmitting region; and a first lens, the first light-emitting member, the first light-transmitting member and the first lens being sequentially arranged.

The first light-transmitting member may include at least one first light-shading region and at least one first linear light-transmitting region; and the at least one first light-shading region and the at least one first linear light-transmitting region may be connected with each other to jointly form a consecutive region.

The first light-transmitting member may be of a circular sheet structure, and the first linear light-transmitting region may pass through a center of the first light-transmitting member.

The first light-emitting member may include a first light source and a second light-transmitting member; and the second light-transmitting member may be provided between the first light source and the first light-transmitting member; and a second linear light-transmitting region may be defined on the second light-transmitting member, and the linear light band may be generated by irradiating the first light source onto the second linear light-transmitting region.

The first light-emitting member may further include a second lens, and the second lens may be provided between the first light source and the second light-transmitting member.

The first light-emitting member may further include a first light-scattering lens, and the first light-scattering lens may be provided between the second lens and the second light-transmitting member.

The second light-transmitting member may include at least one second light-shading region and at least one second linear light-transmitting region; and the at least one second light-shading region and the at least one second linear light-transmitting region may be connected with each other to jointly form a consecutive region.

Second linear light-transmitting regions may be parallel to each other.

The first light-transmitting member may be located at a focus of the first lens.

The projection device may further include a second light-emitting component or a third light-emitting component;

the second light-emitting component may sequentially include a second light source, a first light-scattering sheet, a second light-scattering sheet and a hemispherical lens, and the first light-scattering sheet may be rotatably connected with the first driving member; and the third light-emitting component may sequentially include a third light source and a first grating sheet, and a starry sky pattern may be provided on the first grating sheet.

The embodiment of the present disclosure has the following beneficial effects: By providing the first light-emitting member for generating the linear light band, star-like spots are generated when the linear light band intersects with the first linear light-transmitting region on the first light-transmitting member, and when the first driving member drives the first light-transmitting member and the first light-emitting member to generate the relative motion, the star-like spots move immediately to generate the meteor-like effect; and therefore, the projection lamp achieves the dynamic meteor effect to improve the user experience.

BRIEF DESCRIPTION OF THE DRAWINGS

The present disclosure is further described below with reference to the accompanying drawings and embodiments. In the drawings.

DETAILED DESCRIPTION OF THE EMBODIMENTS

A clear and complete description of the technical solutions in the embodiments of the present disclosure will be given below, in combination with the accompanying drawings in the embodiments of the present disclosure. Apparently, the embodiments described below are a part, but not all, of the embodiments of the present disclosure. All other embodiments obtained by those of ordinary skill in the art based on the embodiments in the present disclosure without creative efforts shall fall within the protection scope of the present disclosure.

It should be noted that all the directional indications (such as upper, lower, left, right, front, back, etc.) in the embodiments of the present disclosure are merely used to explain a relative position relationship, motion situations, and the like of the components in a specific gesture (as shown in the figures). If the specific gesture changes, the directional indication also changes accordingly.

Moreover, the terms such as "first", "second", and the like described in the embodiments of the present disclosure are used herein only for the purpose of description and are not intended to indicate or imply relative importance, or implicitly indicate the number of the indicated technical features. Therefore, features defined by "first" and "second" may explicitly or implicitly include at least one of the features. Furthermore, the technical solutions between the various embodiments may be combined one another, but must be on the basis that the combination thereof can be implemented by those of ordinary skill in the art. In case of a contradiction with the combination of the technical solutions or a failure to implement the combination, it should be considered that the combination of the technical solutions does not exist, and is not within the protection scope of the present disclosure.

Figure 1:
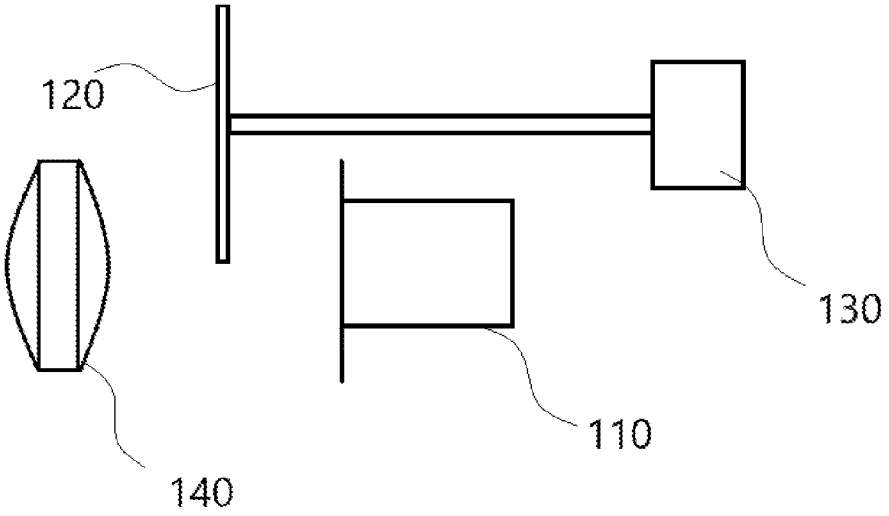
FIG. 1 is a structural schematic view of a first embodiment of a projection device provided by the present disclosure.

FIG. 1 is a structural schematic view of a first embodiment of a projection device provided by the present disclosure.

The projection device includes: a first light-emitting component. The first light-emitting component includes a first light-emitting member 110, a first light-transmitting member 120, a first driving member 130 and a first lens 140. The first lens 140 may be a biconvex lens, a biconcave lens, a planoconvex lens, a planoconcave lens, a positive meniscus lens or a negative meniscus lens or the like. The first lens 140 is used for amplifying light passing through the first light-transmitting member 120 and projecting the light. The first light-emitting member 110, the first light-transmitting member 120 and the first lens 140 are arranged sequentially, such that light generated from the first light-emitting member 110 can be projected through the first light-transmitting member 120 and the first lens 140.

Figure 3:
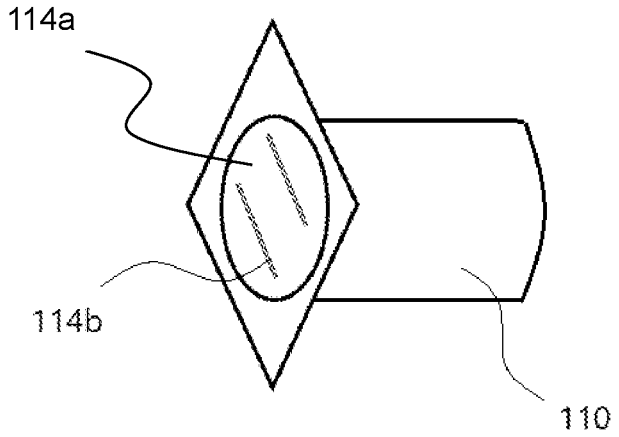
FIG. 3 is a stereoscopic schematic structural view of a first embodiment of a first light-emitting member provided by the present disclosure.
Figure 4:
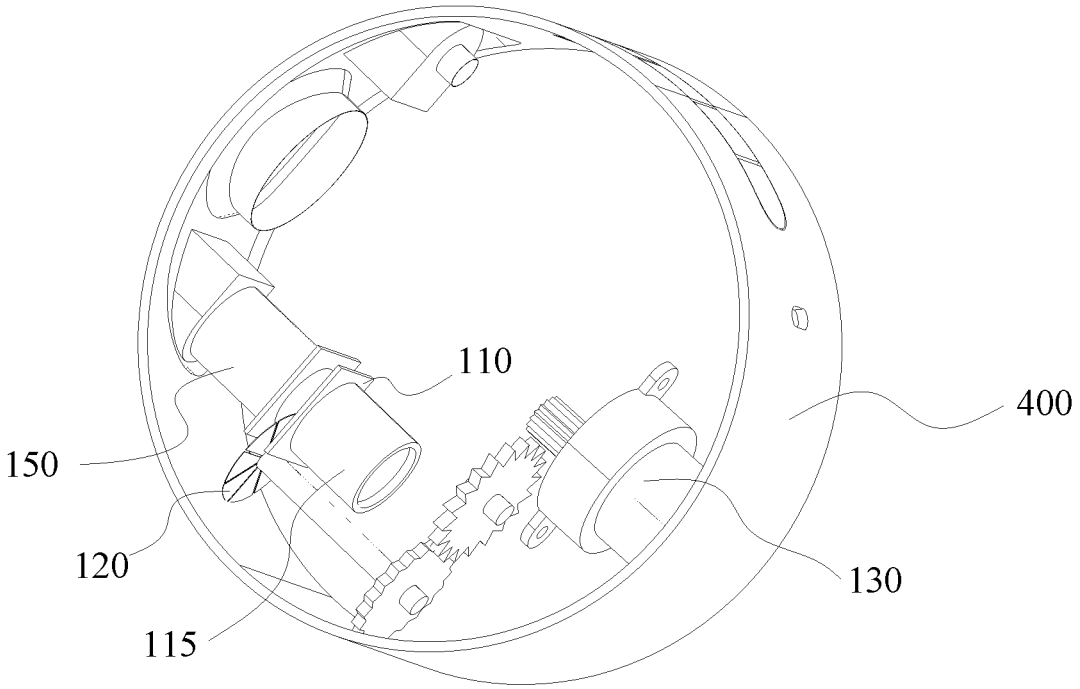
FIG. 4 is a schematic structural view of a second embodiment of a projection device provided by the present disclosure.

The first light-emitting member 110 is used for generating a linear light band. The linear light band is specifically a light band of a line type. The light band may be of a straight line, and may also be of a curved line. Specifically, as shown in FIG. 3, at least one second linear light-transmitting region 114*b* for generating at least one linear light band may be defined on the first light-emitting member 110.

Figure 2:
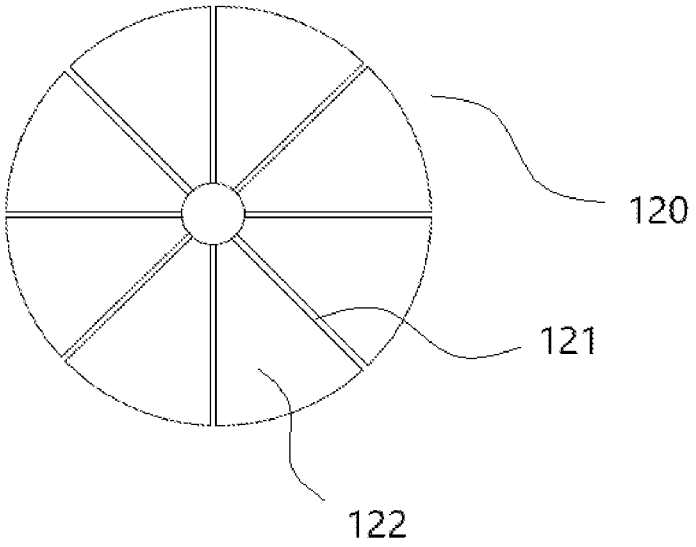
FIG. 2 is a front view of an embodiment of a first light-transmitting member provided by the present disclosure.

For the first light-transmitting member 120, the first light-transmitting member 120 is defined with a first linear light-transmitting region 121. The first linear light-transmitting region 121 is used for passing through a part of light in the linear light band generated by the first light-emitting member 110. The first linear light-transmitting region 121 may specifically be a light-transmitting region of a line type. The light-transmitting region may be of a straight line, and may also be of a curved line. As shown in FIG. 2, the first light-transmitting member 120 includes at least one first light-shading region 122 and at least one first linear light-transmitting region 121; and the at least one first light-shading region 122 and the at least one first linear light-transmitting region 121 are connected with each other to jointly form a consecutive region (namely the first light-transmitting member 120). The first light-shading region 122 is used for obstructing the light in the linear light band to pass through. The first linear light-transmitting region 121 may be a hollow region, and may also be a region made of a material capable of passing through the light. The first light-transmitting member 120 may be a film, which is specifically a printing film.

Preferably, as an implementation, the first light-transmitting member 120 may be of a circular sheet structure, and the first linear light-transmitting region 121 passes through a center of the first light-transmitting member 120. Specifically, a length of the first linear light-transmitting region 121 may be the same as a radius of the first light-transmitting member 120, and may also be the same as a diameter of the first light-transmitting member 120. When the length of the first linear light-transmitting region 121 is the same as the diameter of the first light-transmitting member 120, an included angle between any two adjacent first linear light-transmitting regions 121 may be the same, such that velocities for generating *meteors* are the same. Certainly, the included angle between any two adjacent first linear light-transmitting regions 121 may also be different.

The first driving member 130 is fixedly connected with the first light-emitting member 110 or the first light-transmitting member 120, and used for allowing the first light-emitting member 110 and the first light-transmitting member 120 to generate a relative motion, and allowing the linear light band to intersect with the first linear light-transmitting region 121. The first driving member 130 may allow the first light-emitting member 110 and the first light-transmitting member 120 to generate the relative reciprocating motion such as the back-and-forth motion, or the rotary motion.

In the embodiment of the present disclosure, by providing the first light-emitting member 110 for generating the linear light band, star-like spots are generated when the linear light band intersects with the first linear light-transmitting region 121 on the first light-transmitting member 120, and when the first driving member 130 drives the first light-transmitting member 120 and the first light-emitting member 110 to generate the relative motion, the star-like spots move immediately to generate the meteor-like effect; and therefore, the projection lamp achieves the dynamic meteor effect to improve the user experience.

Figure 5:
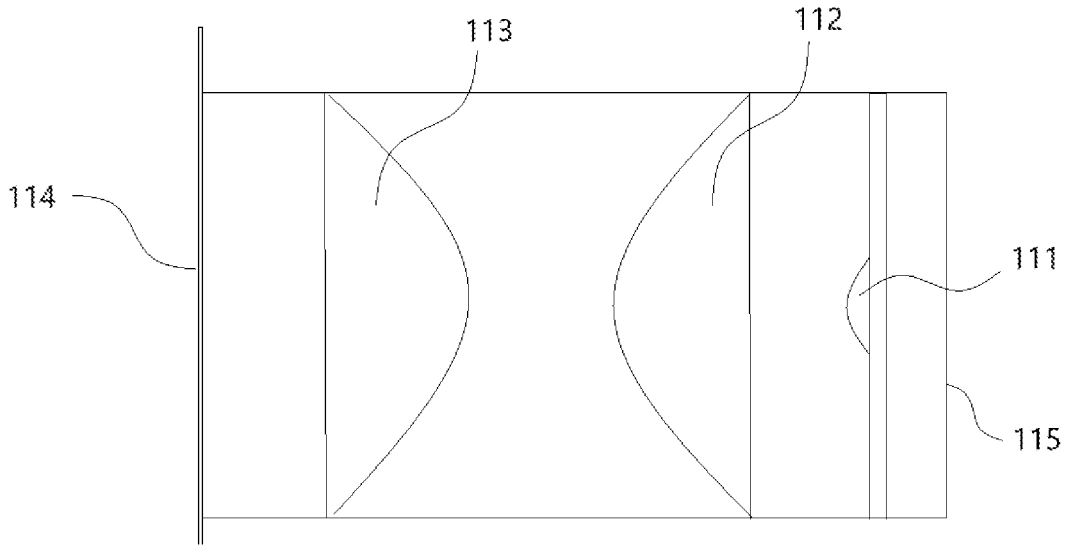
FIG. 5 is an exploded view of a second embodiment of a first light-emitting member provided by the present disclosure.

FIG. 5 is a structural schematic view of a second embodiment of a projection device provided by the present disclosure.

The projection device includes: a first light-emitting component and a shell 400. The first light-emitting component is fixed in the shell 400. The first light-emitting component includes: a first light-emitting member 110, a first light-transmitting member 120, a first driving member 130 and a first lens 140. The first lens 140 may be a biconvex lens, a biconcave lens, a planoconvex lens, a planoconcave lens, a positive meniscus lens or a negative meniscus lens or the like. In the embodiment, the first lens 140 is preferably the biconvex lens. The first lens 140 is used for amplifying light passing through the first light-transmitting member 120 and projecting the light. The first light-emitting member 110, the first light-transmitting member 120 and the first lens 140 are arranged sequentially, such that light generated from the first light-emitting member 110 can be projected through the first light-transmitting member 120 and the first lens 140. Preferably, in order to obtain the clearer projection effect, the first light-transmitting member 120 is located at a focus of the first lens 140. A first aperture corresponding to the first lens 140 is formed in the shell.

The first light-emitting member 110 is used for generating a linear light band. The linear light band is specifically a light band of a line type. The light band is of a straight line. As shown in FIG. 5, the first light-emitting member 110 includes a first light source 111, a second lens 112, a first light-scattering lens 113 and a second light-transmitting member 114. The second light-transmitting member 114 is provided between the first light source 111 and the first light-transmitting member 120. A second linear light-transmitting region is defined on the second light-transmitting member 114, and the linear light band is generated by irradiating the first light source 111 onto the second linear light-transmitting region. Specifically, the second light-transmitting member 114 includes at least one second light-shading region 114*a* and at least one second linear light-transmitting region 114*b*; and the at least one second light-shading region 114*a* and the at least one second linear light-transmitting region 114*b* are connected with each other to jointly form a consecutive region. Second linear light-transmitting regions 114*b* are parallel to each other.

The first light source 111, the second lens 112, the first light-scattering lens 113 and the second light-transmitting member 114 are sequentially arranged. The second lens 112 is used for focusing light from the first light source 111 to enhance the light intensity. The first light-scattering lens 113 is used for scattering light focused by the second lens 112, such that the luminance of light entering the second light-transmitting member 114 is consistent as much as possible, to reduce the phenomenon of the inconsistent luminance of the light at each place of the second linear light-transmitting region 114*b*.

Preferably, the first light-emitting member 110 further includes a first fixing member 115. The first fixing member 115 is fixed in the shell. The first fixing member 115 is used for fixing the first light source 111, the second lens 112, the first light-scattering lens 113 and the second light-transmitting member 114. Specifically, the first fixing member 115 may be a hollow cylinder, and the first light source 111, the second lens 112, the first light-scattering lens 113 and the second light-transmitting member 114 are sequentially arranged in the cylinder. In order to reduce the light leakage, a light-shading layer may be provided on an outer surface of the cylinder. Specifically, the second lens 112 and the first light-scattering lens 113 are both a solid hemispherical lens. The second lens and the first light-scattering lens 113 are opposite in spherical surface.

Figure 6:
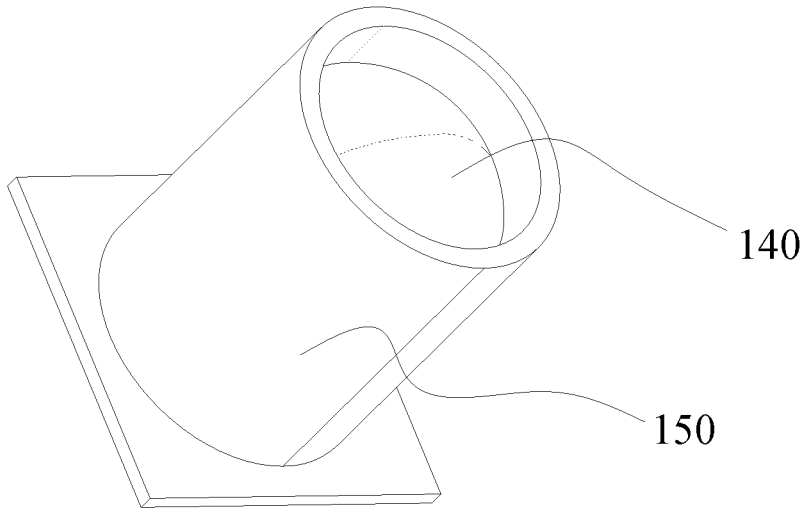
FIG. 6 is an assembly view of an embodiment of a second fixing member and a first lens provided by the present disclosure.

Further, the first light-emitting component further includes a second fixing member 150, the second fixing member 150 being used for fixing the first lens 140. As shown in FIG. 6, the second fixing member 150 may also be a hollow cylinder, and the first lens 140 is provided on an end portion of the cylinder. In order to reduce the light leakage, the second fixing member 150 may also be provided with a light-shading layer. Preferably, the first fixing member 115 and the second fixing member 150 are coaxial, and the first fixing member 115 and the second fixing member 150 have the same bottom radius.

For the first light-transmitting member 120, the first light-transmitting member 120 is defined with a first linear light-transmitting region 121. The first linear light-transmitting region 121 is used for passing through a part of light in the linear light band generated by the first light-emitting member 110. The first linear light-transmitting region 121 may specifically be a light-transmitting region of a line type. The light-transmitting region is of a straight line. The first light-transmitting member 120 includes at least one first light-shading region 122 and at least one first linear light-transmitting region 121; and the at least one first light-shading region 122 and the at least one first linear light-transmitting region 121 are connected with each other to jointly form a first consecutive region. The first light-shading region 122 is used for obstructing the light in the linear light band to pass through. The first linear light-transmitting region 121 may be a hollow region, and may also be a region made of a material capable of passing through the light. The first light-transmitting member 120 may be a film, which is specifically a printing film.

Preferably, as an implementation, the first region is the first light-transmitting member 120, and the first linear light-transmitting region 121 passes through a center of the first light-transmitting member 120. Specifically, a length of the first linear light-transmitting region 121 may be the same as a radius of the first light-transmitting member 120, and may also be the same as a diameter of the first light-transmitting member 120. When the length of the first linear light-transmitting region 121 is the same as the diameter of the first light-transmitting member 120, an included angle between any two adjacent first linear light-transmitting regions 121 may be the same, such that velocities for generating *meteors* are the same. Certainly, the included angle between any two adjacent first linear light-transmitting regions 121 may also be different.

The first driving member 130 is fixedly connected with the first light-transmitting member 120, and used for allowing the first light-emitting member 110 and the first light-transmitting member 120 to generate a relative motion, and allowing the linear light band to intersect with the first linear light-transmitting region 121. The first driving member 130 may allow the first light-emitting member 110 and the first light-transmitting member 120 to generate the relative reciprocating motion such as the back-and-forth motion, or the rotary motion. Specifically, the first driving member 130 includes a motor and a first connection rod. The first connection rod includes one end connected with the motor, and the other end connected with the first light-transmitting member 120. Specifically, the other end of the first connection rod may be fixedly connected with the center of the first light-transmitting member 120. The motor may drive the first connection rod to rotate, such that the first connection rod drives the first light-transmitting member 120 to rotate.

In the embodiment of the present disclosure, by providing the first light-emitting member 110 for generating the linear light band, star-like spots are generated when the linear light band intersects with the first linear light-transmitting region 121 on the first light-transmitting member 120, and when the first driving member 130 drives the first light-transmitting member 120 and the first light-emitting member 110 to generate the relative motion, the star-like spots move immediately to generate the meteor-like effect; and therefore, the projection lamp achieves the dynamic meteor effect to improve the user experience.

Figure 7:
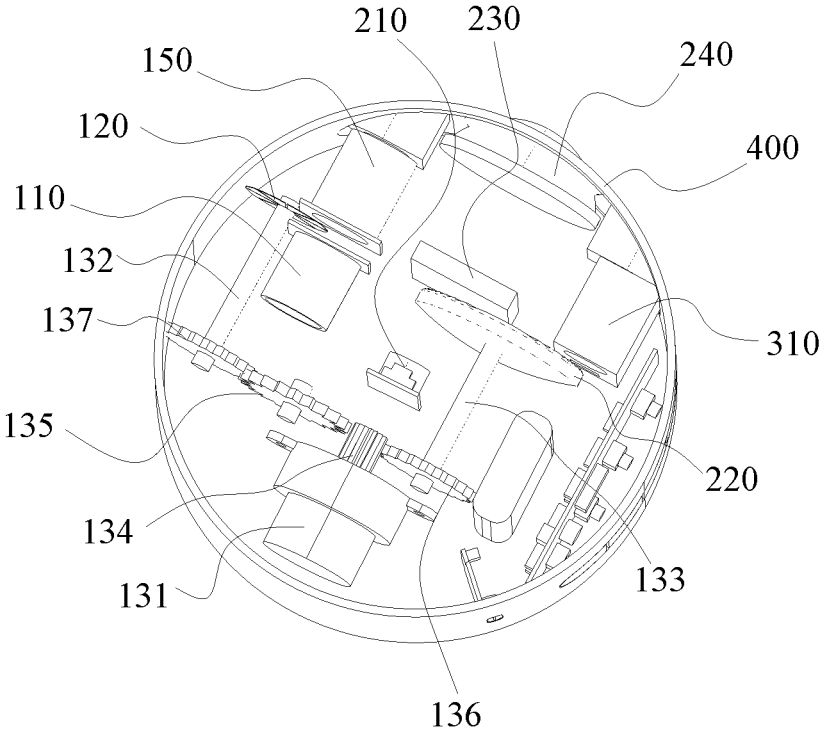
FIG. 7 is an internal schematic structural view of a third embodiment of a projection device provided by the present disclosure.

FIG. 7 is a structural schematic view of a third embodiment of a projection device provided by the present disclosure.

Figure 8:
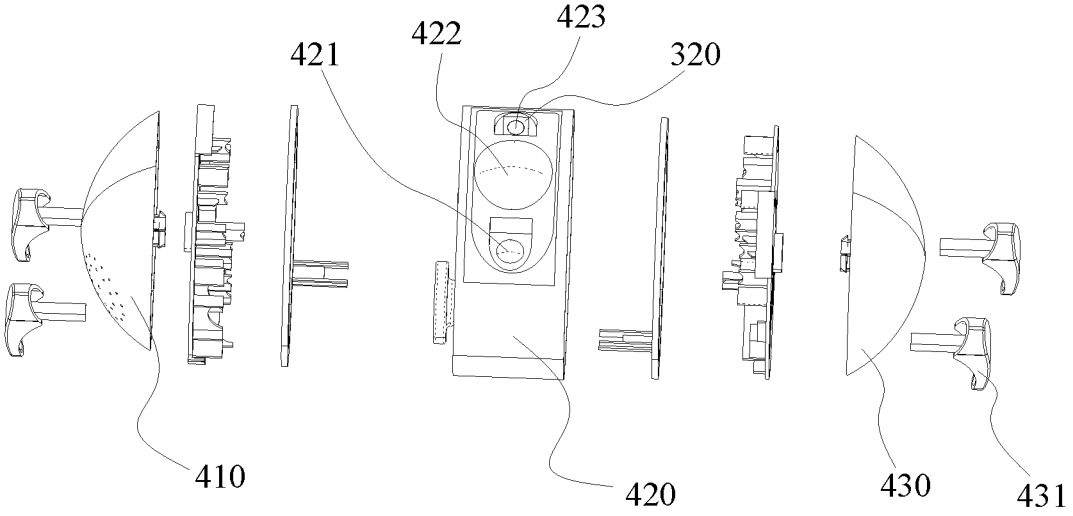
FIG. 8 is an exploded view of a third embodiment of a projection device provided by the present disclosure.

The projection device includes: a first light-emitting component, a second light-emitting component, a third light-emitting component and a shell 400. As shown in FIG. 8, the shell 400 includes an upper hemispherical shell 410, a main shell 420 and a lower hemispherical shell 430. The first light-emitting component, the second light-emitting component and the third light-emitting component are all arranged in the main shell 420. A fixing structure for fixing the first light-emitting component, the second light-emitting component and the third light-emitting component is provided in the upper hemispherical shell 410. A support member 431 is provided outside the lower hemispherical shell 430.

The second light-emitting component sequentially includes a second light source 210, a first light-scattering sheet 220, a second light-scattering sheet 230 and a hemispherical lens 240, and the first light-scattering sheet 220 is rotatably connected with the first driving member 130. The first light-scattering sheet 220 and the second light-scattering sheet 230 are both a glass sheet. Multiple protrusion structures are arranged on a surface, opposite to the second light source 210, of the first light-scattering sheet 220 (or the second light-scattering sheet 230), and the multiple protrusion structures are all of an irregular water-ripple structure. A surface, facing toward the second light source 210, of the first light-scattering sheet 220 (or the second light-scattering sheet 230) is of a smooth flat structure. The first light-scattering sheet 220 may be of a circular planar structure. The second light-emitting component is used for generating bright and dark starfields.

The third light-emitting component sequentially includes a third light source 310 and a first grating sheet 320, and a starry sky pattern is provided on the first grating sheet 320. The third light-emitting component is used for generating multiple star-like spots.

The first light-emitting component includes: a first light-emitting member 110, a first light-transmitting member 120, a first driving member 130 and a first lens 140. The first lens 140 may be a biconvex lens, a biconcave lens, a planoconvex lens, a planoconcave lens, a positive meniscus lens or a negative meniscus lens or the like. In the embodiment, the first lens 140 is preferably the biconvex lens. The first lens 140 is used for amplifying light passing through the first light-transmitting member 120 and projecting the light. The first light-emitting member 110, the first light-transmitting member 120 and the first lens 140 are arranged sequentially, such that light generated from the first light-emitting member 110 can be projected through the first light-transmitting member 120 and the first lens 140. Preferably, in order to obtain the clearer projection effect, the first light-transmitting member 120 is located at a focus of the first lens 140. The main shell 420 is defined with a first aperture 421 corresponding to the first lens 140, a second aperture 422 corresponding to the hemispherical lens, and a third aperture 423 corresponding to the first grating sheet.

The first light-emitting member 110 is used for generating a linear light band. The linear light band is specifically a light band of a line type. The light band is of a straight line. As shown in FIG. 3, the first light-emitting member 110 includes a first light source 111, a second lens 112, a first light-scattering lens 113 and a second light-transmitting member 114. The second light-transmitting member 114 is provided between the first light source 111 and the first light-transmitting member 120. The first light source 111, the second lens 112, the first light-scattering lens 113 and the second light-transmitting member 114 are sequentially arranged. The second lens 112 is used for focusing light from the first light source 111 to enhance the light intensity. The first light-scattering lens 113 is used for scattering light focused by the second lens 112, such that the luminance of light entering the second light-transmitting member 114 is consistent as much as possible, to reduce the phenomenon of the inconsistent luminance of the light at each place of the second linear light-transmitting region 114*b*. A second linear light-transmitting region 114*b* is defined on the second light-transmitting member 114, and the linear light band is generated by irradiating the first light source 111 onto the second linear light-transmitting region 114*b*. Specifically, the second light-transmitting member 114 includes at least one second light-shading region 114*a* and at least one second linear light-transmitting region 114*b*; and the at least one second light-shading region 114*a* and the at least one second linear light-transmitting region 114*b* are connected with each other to jointly form a consecutive region. Second linear light-transmitting regions 114*b* are parallel to each other.

Preferably, the first light-emitting member 110 further includes a first fixing member 115. The first fixing member 115 is fixed in the shell 400. The first fixing member 115 is used for fixing the first light source 111, the second lens 112, the first light-scattering lens 113 and the second light-transmitting member 114. Specifically, the first fixing member 115 may be a hollow cylinder, and the first light source 111, the second lens 112, the first light-scattering lens 113 and the second light-transmitting member 114 are sequentially arranged in the cylinder. In order to reduce the light leakage, a light-shading layer may be provided on an outer surface of the cylinder. Further, the first light-emitting component further includes a second fixing member 150, the second fixing member 150 being used for fixing the first lens 140. The second fixing member 150 may also be a hollow cylinder, and the first lens 140 is provided on an end portion of the cylinder. In order to reduce the light leakage, the second fixing member 150 may also be provided with a light-shading layer. Preferably, the first fixing member 115 and the second fixing member 150 are coaxial, and the first fixing member 115 and the second fixing member 150 have the same bottom radius.

For the first light-transmitting member 120, the first light-transmitting member 120 is defined with a first linear light-transmitting region 121. The first linear light-transmitting region 121 is used for passing through a part of light in the linear light band generated by the first light-emitting member 110. The first linear light-transmitting region 121 may specifically be a light-transmitting region of a line type. The light-transmitting region is of a straight line. The first light-transmitting member 120 includes at least one first light-shading region 122 and at least one first linear light-transmitting region 121; and the at least one first light-shading region 122 and the at least one first linear light-transmitting region 121 are connected with each other to jointly form a consecutive region. The first light-shading region 122 is used for obstructing the light in the linear light band to pass through. The first linear light-transmitting region 121 may be a hollow region, and may also be a region made of a material capable of passing through the light. The first light-transmitting member 120 may be a film, which is specifically a printing film.

Preferably, as an implementation, the first light-transmitting member 120 is of a circular sheet structure, and the first linear light-transmitting region 121 passes through a center of the first light-transmitting member 120. Specifically, a length of the first linear light-transmitting region 121 may be the same as a radius of the first light-transmitting member 120, and may also be the same as a diameter of the first light-transmitting member 120. When the length of the first linear light-transmitting region 121 is the same as the diameter of the first light-transmitting member 120, an included angle between any two adjacent first linear light-transmitting regions 121 may be the same, such that velocities for generating *meteors* are the same. Certainly, the included angle between any two adjacent first linear light-transmitting regions 121 may also be different.

The first driving member 130 is fixedly connected with the first light-transmitting member 120, and used for allowing the first light-emitting member 110 and the first light-transmitting member 120 to generate a relative motion, and allowing the linear light band to intersect with the first linear light-transmitting region 121. The first driving member 130 may allow the first light-emitting member 110 and the first light-transmitting member 120 to generate the relative reciprocating motion such as the back-and-forth motion, or the rotary motion. The first driving member 130 is further used for driving the first light-scattering sheet to rotate. Specifically, the first driving member 130 includes a motor 131, a first connection rod 132, a second connection rod 133, a driving wheel 134, a first driven wheel 135, a second driven wheel 136 and a third driven wheel 137. A driving shaft of the motor is fixedly connected with the driving wheel 134, the driving wheel 134 is respectively engaged with the first driven wheel 135 and the second driven wheel 136, and the first driven wheel 135 is engaged with the third driven wheel 137. The first connection rod 132 includes one end connected with the third driven wheel 137, and the other end connected with a center of the first light-transmitting member 120. The second connection rod 133 includes one end connected with the second driven wheel 136, and the other end connected with a center of the first light-scattering sheet 220.

In the embodiment of the present disclosure, the first light-emitting component may generate the meteor effect, the second light-emitting component generates the bright and dark starfields, and the third light-emitting component generates the multiple star-like spots; and the combination of the above three components can generate more vivid and rich visual effect to improve the user experience.

The embodiments of the present disclosure have been described above with reference to the accompanying drawings, but the present disclosure is not limited to the above specific embodiments. The above specific embodiments are merely illustrative rather than restrictive. Under the inspiration of the present disclosure, those of ordinary skill in the art can make a variety of improvements without departing from the purpose of the present disclosure and the protection scope defined by the claims, and all these improvements shall fall within the protection scope of the present disclosure.

What is claimed is:

1. A projection device, comprising a first light-emitting component, wherein the first light-emitting component comprises:

a first light-emitting member for generating a linear light band;

a first light-transmitting member defined with a first linear light-transmitting region;

a first driving member, fixedly connected with the first light-emitting member or the first light-transmitting member, and configured for allowing the first light-emitting member and the first light-transmitting member to generate a relative motion, and allowing the linear light band to intersect with the first linear light-transmitting region; and a first lens, wherein the first light-emitting member, the first light-transmitting member and the first lens are sequentially arranged;

wherein the first light-emitting member comprises a first light source and a second light-transmitting member; and the second light-transmitting member is provided between the first light source and the first light-transmitting member; and a second linear light-transmitting region is defined on the second light-transmitting member, and the linear light band is generated by irradiating the first light source onto the second linear light-transmitting region.

2. The projection device according to claim 1, wherein the first light-transmitting member comprises at least one first light-shading region and at least one first linear light-transmitting region; and the at least one first light-shading region and the at least one first linear light-transmitting region are connected with each other to jointly form a consecutive region.

3. The projection device according to claim 2, wherein the first light-transmitting member is of a circular sheet structure, and the first linear light-transmitting region passes through a center of the first light-transmitting member.

4. The projection device according to claim 1, wherein the first light-emitting member further comprises a second lens, and the second lens is provided between the first light source and the second light-transmitting member.

5. The projection device according to claim 4, wherein the first light-emitting member further comprises a first light-scattering lens, and the first light-scattering lens is provided between the second lens and the second light-transmitting member.

6. The projection device according to claim 1, wherein the second light-transmitting member comprises at least one second light-shading region and at least one second linear light-transmitting region; and the at least one second light-shading region and the at least one second linear light-transmitting region are connected with each other to jointly form a consecutive region.

7. The projection device according to claim 6, wherein the second light-transmitting member comprises at least two second linear light-transmitting regions; and the second linear light-transmitting regions are parallel to each other.

8. The projection device according to claim 1, wherein the first light-transmitting member is located at a focus of the first lens.

9. The projection device according to claim 1, further comprising a second light-emitting component or a third light-emitting component;

the second light-emitting component sequentially comprises a second light source, a first light-scattering sheet, a second light-scattering sheet and a hemispherical lens, and the first light-scattering sheet is rotatably connected with the first driving member; or the third light-emitting component sequentially comprises a third light source and a first grating sheet, and a starry sky pattern is provided on the first grating sheet.

* * * * *